United States Patent [19]

Mizuki

[11] Patent Number: 5,015,020

[45] Date of Patent: May 14, 1991

[54] VEHICULAR DOOR LOCKIING DEVICE

[75] Inventor: Tetsuro Mizuki, Nirasaki, Japan

[73] Assignee: Mitsui Kinzoku Kogyo Kabushiki Kaisha, Tokyo, Japan

[21] Appl. No.: 461,904

[22] Filed: Jan. 8, 1990

[30] Foreign Application Priority Data

Jan. 11, 1989 [JP] Japan ..... 1-3974
Jan. 12, 1989 [JP] Japan ..... 1-5443

[51] Int. Cl.[5] ..... E05C 3/26

[52] U.S. Cl. ..... 292/216; 292/DIG. 26; 292/336.3

[58] Field of Search ..... 292/DIG. 26, 201, 336.3, 292/216, 280

[56] References Cited

U.S. PATENT DOCUMENTS 3,614,146 10/1971 Marx ..... 292/DIG. 26 X
3,695,662 10/1972 Ploughman ..... 292/216
4,097,077 6/1978 Gahrs ..... 292/DIG. 26 X

FOREIGN PATENT DOCUMENTS 50-94630 7/1975 Japan .
128221 9/1977 Japan .
63-93979 4/1988 Japan .

*Primary Examiner*—Richard E. Moore
*Attorney, Agent, or Firm*—Browdy and Neimark

[57] ABSTRACT

The vehicular door locking device according to the present invention with a ratchet fastened pivotably to a locking device body via a first shaft, adapted to prevent the reverse turning of a latch and having a first projection; an opening lever mounted pivotably on the first shaft, connected to a door handle and having an elongated bore extending radially with respect to the first shaft; an L-shaped locking lever mounted fixedly on an output shaft of an actuator, adapted to be turned between a locking position and an unlocking position, and having a first arm to which one end portion of a rod extending to a sill knob on a door is connected, and a second arm; and an interlocking member connected pivotably to the second arm via a second shaft and having a second projection engaged with the elongated bore. When the locking lever is in the unlocking position, the first and second shafts are aligned with each other, and the first and second projections are positioned in a mutually opposed state.

2 Claims, 6 Drawing Sheets

VEHICULAR DOOR LOCKIING DEVICE

BACKGROUND OF THE INVENTION

1. Field of the Invention

This invention relates to a vehicular door locking device.

2. Description of the Prior Art

Japanese Patent Laid-Open No. 93979/1988 discloses as shown in FIG. 15 a locking device having an opening lever A adapted to be moved vertically by a door handle, an interlocking member C connected to a ratchet via a pin B, and a locking lever E mounted fixedly on an output shaft of an actuator D. A sill knob F is connected to a first arm of the locking lever E, and the opening lever A to a second arm thereof. The locking lever E is turned by the actuator D or the sill knob F so as to be switched from an unlocking position in which a projection G of the opening lever A and a projection H of the interlocking member C are opposed to each other to a locking position in which the lever A and projection H are not opposed to each other, and vice versa.

This known locking device is disadvantageous in that the interlocking member C is turned around a shaft I with respect to the vertically moving opening lever A. Namely, when the opening lever A is moved down to turn the interlocking member C, the positional relation between the projection G and projection H varies, so that a sense of unbelongingness falls upon an operator.

In this known locking device, the sill knob F is connected to the first arm of the vertically moving locking lever E. Accordingly, this locking device can be applied to a front door on which the sill knob F is positional just above the locking device but not to a rear door on which the sill knob F is positioned far ahead of the locking device.

Japanese Patent Laid-Open No. 94630/1975 and Japanese Utility Model Laid-Open No. 128221/1977 disclose as shown in FIG. 16 a locking device in which the above-mentioned disadvantages are eliminated by mounting an opening lever A and an interlocking member C on the same shaft I and providing a locking lever E in a higher position spaced considerably from the opening lever A and interlocking member C.

The locking device shown in this drawing is not provided with an actuator, and it is considerably difficult to connect an actuator to the locking lever E.

SUMMARY OF THE INVENTION

Therefore, the present invention provides an actuator-carrying locking device capable of solving all of the above-mentioned disadvantages of the known devices of this kind at once, and having an excellent and agreeable performance.

The vehicular locking device according to the present invention is designed so that it can also be applied to a rear door.

DESCRIPTION OF THE PREFERRED EMBODIMENT

Figure 1:
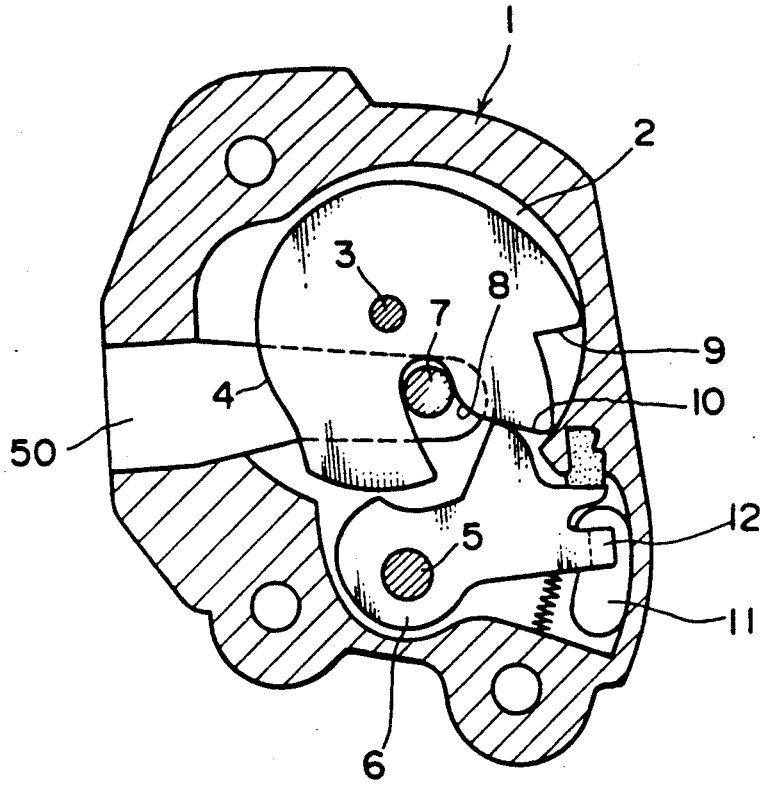
FIG. 1 is a sectioned front elevation of the locking device according to the present invention.

An embodiment of the present invention will now be described with reference to the drawings. Referring to FIG. 1, a latch 4 and a ratchet 6 are supported firmly via shafts 3, 5, respectively, in a recess 2 in the front surface of a locking device body 1 formed out of a synthetic resin. The ratchet 6 is adapted to engage a stepped half locking portion 9 or a stepped full locking portion 10 and prevent the latch 4 from being turned reversely. A cover plate (not shown) extending over the recess 2 is provided in the front side of the device body 1. This locking device is attached to a door with screws 14 with the cover plate exposed at the rear side of the door. Accordingly, the axial directions of the shafts 3, 5 become parallel to the travelling direction of the vehicle.

A guide recess 50 which a striker 7 fixed to a chassis enters is formed in the device body 1. A projection 12 provided at an end portion of the ratchet 6 extends through a through bore 11 in the device body 1 to project from the rear side thereof. A reference numeral 8 denotes a locking recess with which the striker 7 is engaged.

Figure 4:
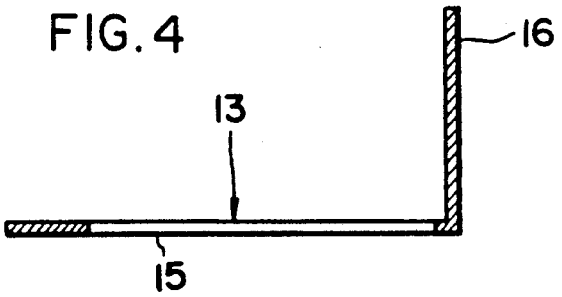
FIG. 4 is a sectional view of a back plate.

A back plate 13 consisting of a metal plate is provided on the rear side of the device body 1. The back plate 13 is fixed to the device body 1 via the shafts 3, 5, and has a flat portion 15 and a standing portion 16 extending at right angles to the flat portion 15 (FIG. 4).

An actuator 51 is provided beneath the device body 1. The actuator 51 consists of a reduction gear 17 and a motor 18, an output shaft 19 being provided at a predetermined portion of the reduction gear 17. A case for the actuator 51 has a two-split structure consisting of front and rear members fastened to each other with screws 20. The front member of the case for the actuator 51 is formed integrally with the device body 1.

Figure 10:
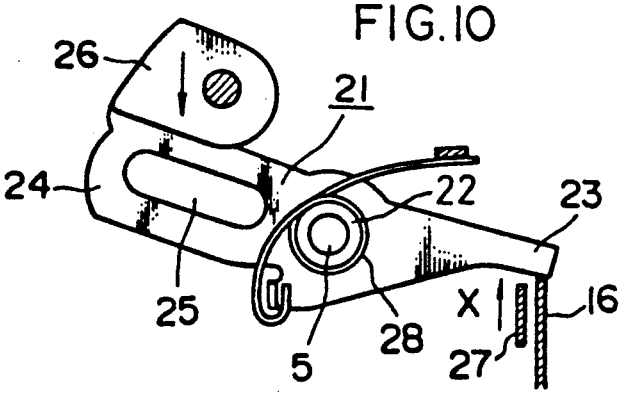
FIG. 10 is a rear elevation of the opening lever.
Figure 13:
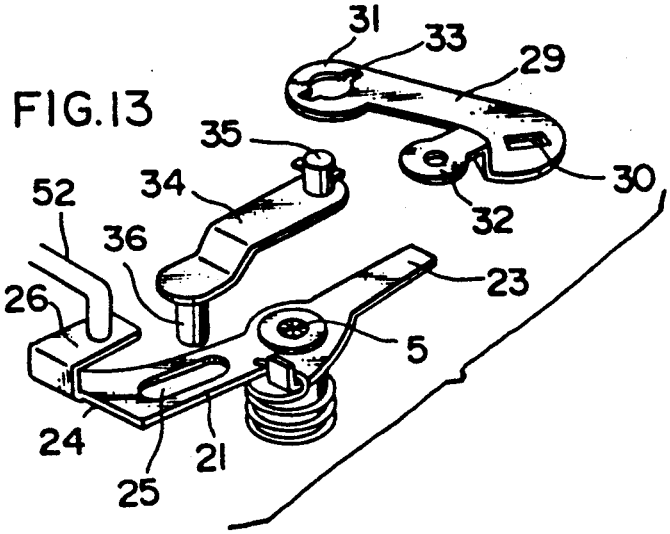
FIG. 13 is a perspective view of the opening lever, interlocking member and L-shaped locking lever.
Figure 11:
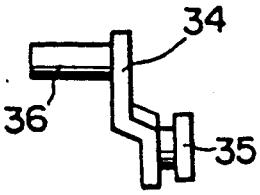
FIG. 11 is a side elevation of an interlocking member.

The shaft 5 extends through the device body 1 to project from the rear surface thereof, and an opening lever 21 is mounted firmly at its shaft inserting bore 22 on this projecting portion of the shaft 5 (FIGS. 10 and 13). The opening lever 21 has two members 23, 24, and the second member 24 is provided with an elongated bore 25, which extends in the radial direction of the shaft inserting bore 22, and an L-shaped bent portion 26. A rod 52 joined to an outer handle (not shown) of a door is connected to this L-shaped bent portion 26.

An operating lever 27 which is adapted to be turned by an inner handle (not shown) of the door, is opposed to the lower side of the first member 23 (FIG. 10). When the operating lever 27 is moved up in the direction designated by the letter X, the first member 23 is raised thereby, so that the opening lever 21 is turned to left. The opening lever 21 is urged by a return spring 28 so that the first member 23 contacts the standing portion 16. Although the elongated bore 25 in the second member extends to a position above the projection 12, the second member 24 does not engage the projection 12 even when the second member 24 is turned.

The axes of the output shaft 19 and shaft 5 are parallel to each other, and a through bore 30 in an L-shaped locking lever 29 is fitted around the output shaft 19. The locking lever 29 is turned by the actuator 51 at around 20° between the positions shown in FIGS. 2 and 3. Accordingly, one member 31 of the locking lever 29 is moved laterally, while the other member 32 thereof is moved vertically. A bore 33 is formed in the first member 31, and a projection 35 of an interlocking member 34 is engaged with this bore 33.

Figure 2:
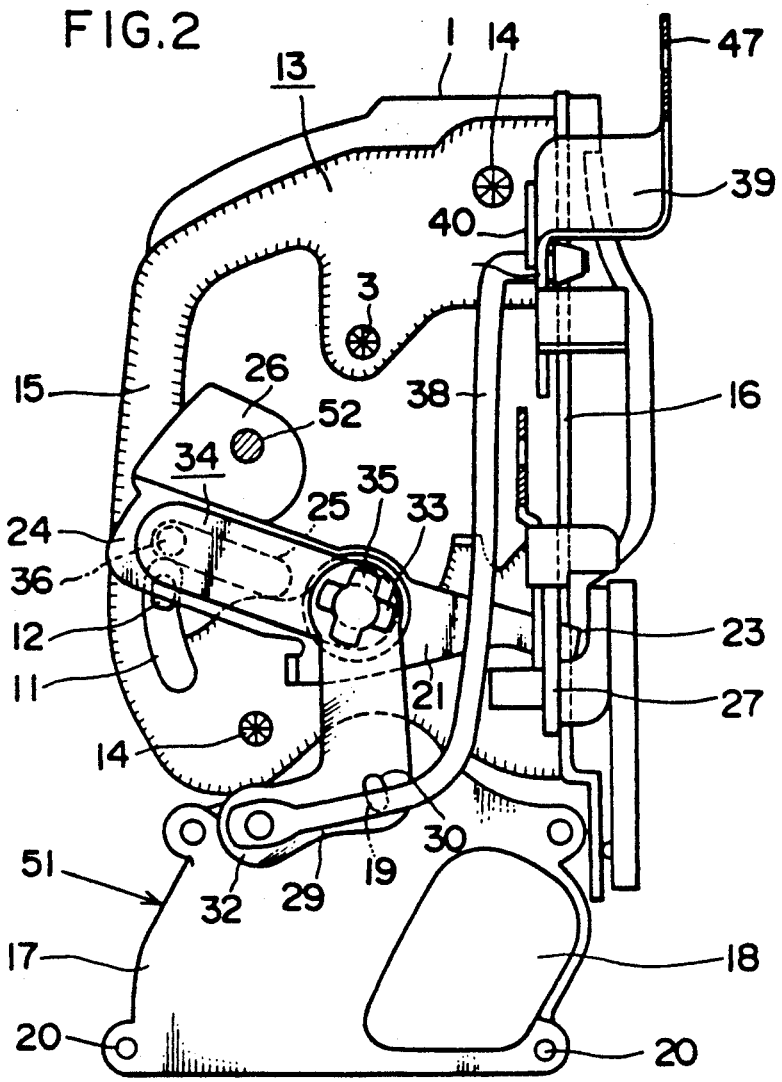
FIG. 2 is a rear elevation of the locking device in an unlocked state.
Figure 3:
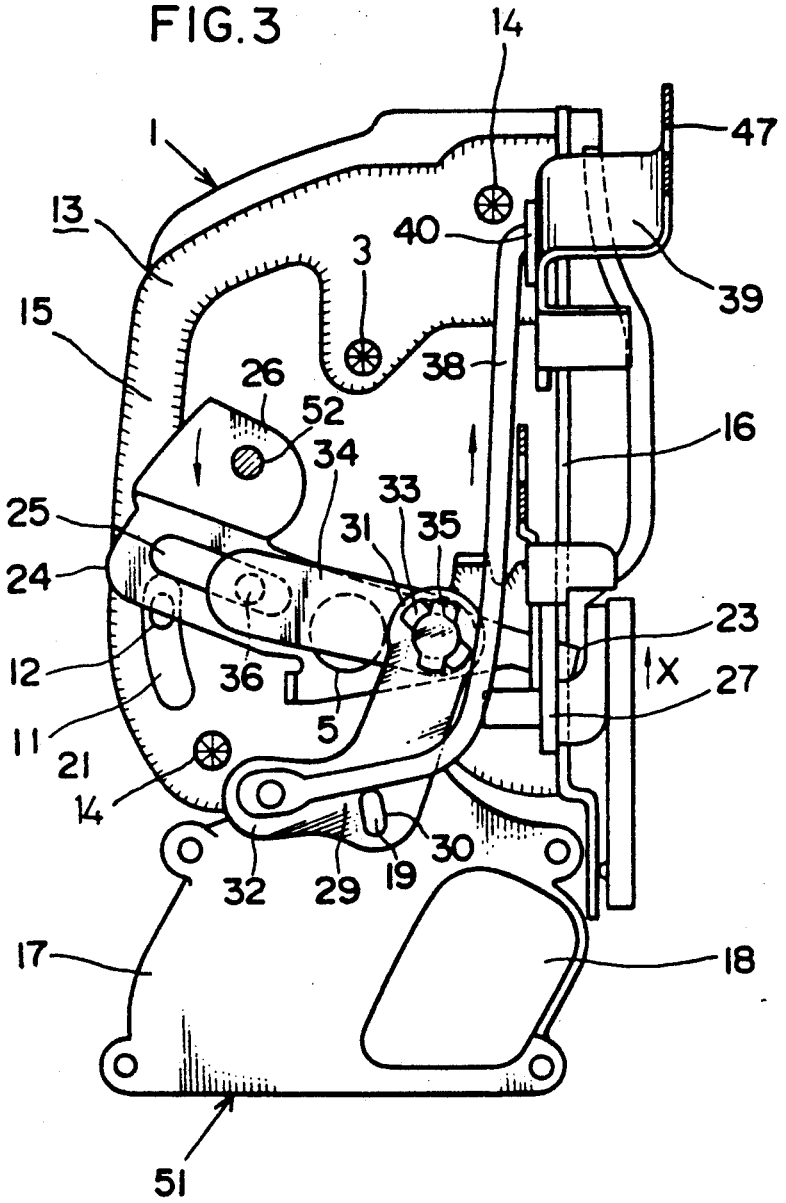
FIG. 3 is a rear elevation of the locking device in a locked state.
Figure 5:
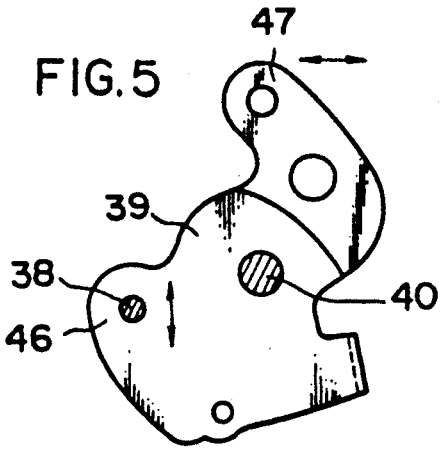
FIG. 5 is a side elevation of an intermediate lever.
Figure 6:
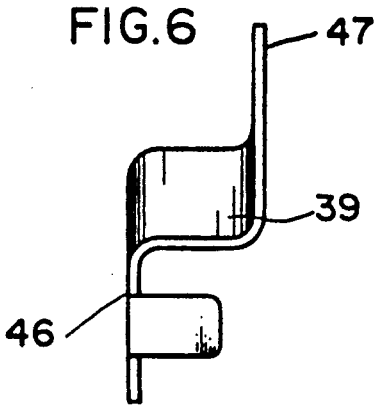
FIG. 6 is a rear elevation of the intermediate lever.
Figure 7:
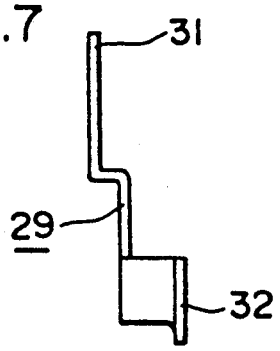
FIG. 7 is a side elevation of an L-shaped locking lever.
Figure 8:
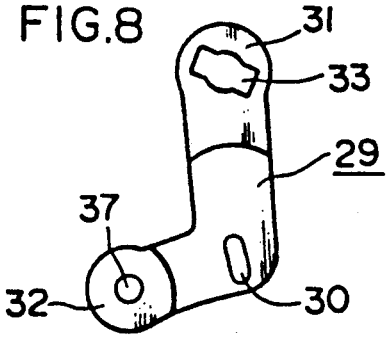
FIG. 8 is a rear elevation of the L-shaped locking lever.
Figure 9:
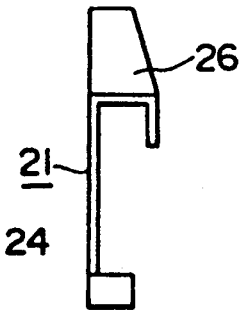
FIG. 9 is a side elevation of an opening lever.

The interlocking member 34 is provided at its free end portion with a locking pin 36 projecting toward the device body 1, and this pin 36 is engaged with the elongated bore 25 in the opening lever 21. The condition in which the locking pin 36 is opposed to the projection 12 as shown in FIG. 2 indicates that the locking device is in an unlocked state, and the condition in which the locking pin 36 is not opposed to the projection 12 as shown in FIG. 3 that the locking device is in a locked state. When the locking device is in an unlocked state, the axes of the projection 35 of the interlocking member 34 and shaft 5 are aligned with each other. Accordingly, the interlocking member 34 and opening lever 21 has at this time the same axis of pivotal movement.

Figure 14:
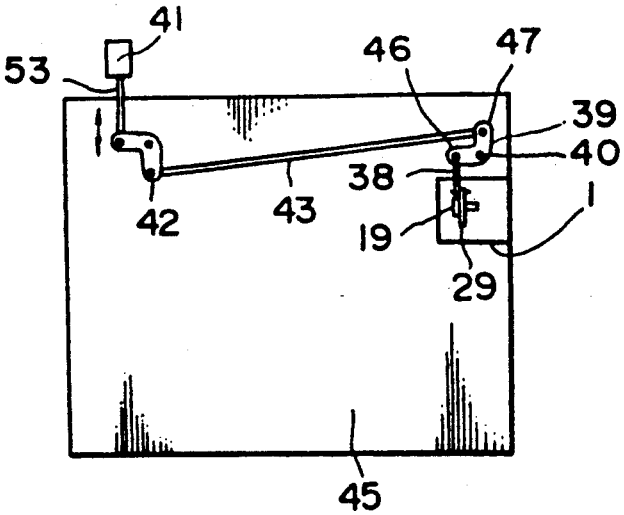
FIG. 14 illustrates the condition of the locking device and a sill knob connected together.
Figure 12:
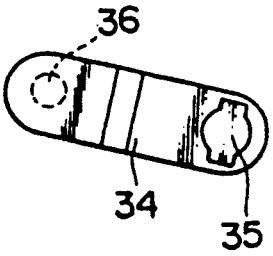
FIG. 12 is a rear elevation of the interlocking member.
Figure 15:
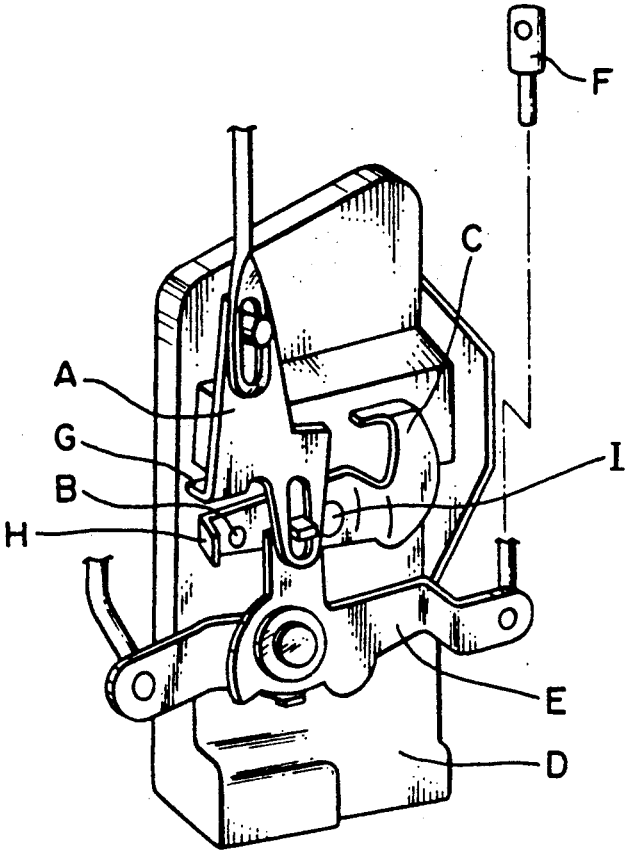
FIG. 15 (PRIOR ART)
FIGS. 15 and 16 illustrate examples of known locking devices.
Figure 16:
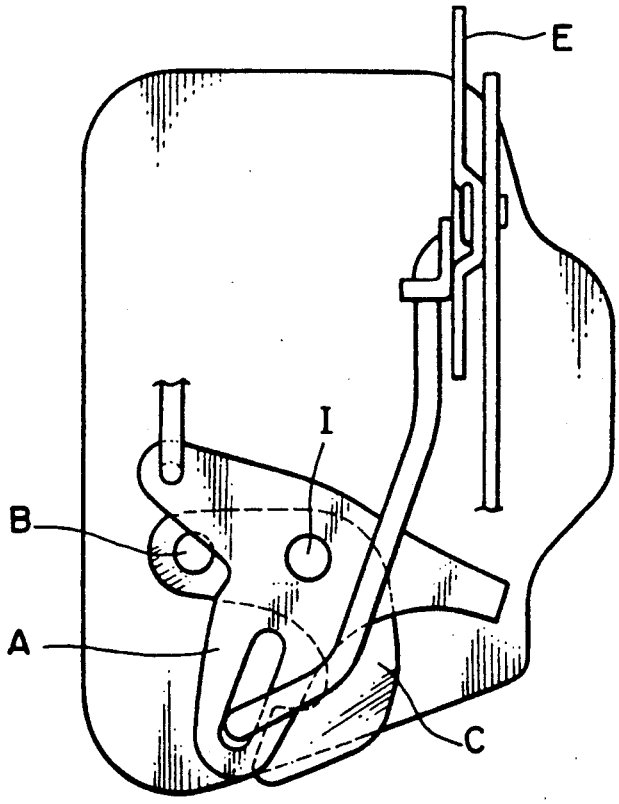
FIG. 16 (PRIOR ART)

The lower end portion of a rod 38 is fastened via a shaft in a through bore 37 in the second member 32 of the L-shaped locking lever 29, and the upper end portion of the rod 38 is engaged with one member 46 of an intermediate lever 39. The intermediate lever 39 is fastened via a shaft 40 to the standing portion 16. Accordingly, the axis of the shaft 40 becomes parallel to the lateral direction of the vehicle. The other member 47 of the intermediate lever 39 is connected to a sill knob 41 on a rear door 45 via a rod 43, a crank 42 and a rod 53 (FIG. 14).

Operation

What is shown in FIG. 2 is an unlocked state of this locking device. When the operating lever 27 is turned by the inner handle to turn the opening lever 21 to left, or, when the opening lever 21 is turned to left directly by the outer handle, the pin 36 of the interlocking member 34 engaged with the elongated bore 25 is moved down to engage the projection 12 of the ratchet 6 and cause the ratchet 6 to turn and disengage from the latch 4. As a result, the striker 7 is released from the latch 4, so that the door is opened.

During this time, the pin 36 is turned around the projection 35 of the interlocking member 34. Since the projection 35 and the shaft 5 around which the opening lever 21 and ratchet 6 are turned are aligned with each other, the turning of the interlocking member 34 by the opening lever 21 can be done smoothly. Even while the pin 36 is turned, the pin 36 and projection 12 do not go out of alignment with each other, the turning of the ratchet 6 is also done smoothly.

In order to put the locking device in a locked state, the sill knob 41 on the front door is pressed. Consequently, the crank 42 is turned to left, and the rod 43 is moved to right with the intermediate lever 39 turned to right around the shaft 40 in FIG. 14. As a result, the rod 38 in the condition shown in FIG. 2 is lifted to a position in which the rod 38 is in the condition shown in FIG. 3, and the L-shaped locking lever 29 with which the lower end portion of the rod 38 is engaged is turned to right around the output shaft 19.

The first member 31 of the L-shaped locking lever 29 is then moved to right to cause the interlocking member 34, which is engaged with the bore 33 in the first member 31, to be moved to right, so that the locking pin 36 at the free end portion of the interlocking member 34 moves rightward in the elongated bore 25 to a position in which the locking pin 36 is not opposited to the projection 12 (FIG. 3). Therefore, even if the opening lever 21 is turned to left, the locking pin 36 does not contact the projection 12. Accordingly, the ratchet 6 is not turned, so that the door cannot be opened.

The above is a discription of and or locking operation carried out by a sill knob-pressing action. The door can also be locked by turning the output shaft 19 to right by an operation of the actuator 51.

What is claimed is:

1. A vehicular door locking device comprising a locking device body fixed to a door; a latch fastened pivotably to said device body via a shaft and adapted to be engaged with a striker fixed to a chassis; a ratchet fastened pivotably to said device body via a first shaft, adapted to prevent the reverse turning of said latch, and having a first projection; an opening lever mounted pivotably on said first shaft, connected to a door handle, and having an elongated bore extending radially with respect to said first shaft; an actuator joined to said device body; an L-shaped locking lever mounted fixedly on an output shaft of said actuator, adapted to be turned between a locking position and an unlocking position, and having a first arm to which one end portion of a rod extending to a sill knob on said door is connected, and a second arm; and an interlocking member connected pivotably to said second arm via a second shaft and having a second projection engaged with said elongated bore, said first and second shafts being aligned with each other with said first and second projections positioned in a mutually opposed state when said locking lever is in said unlocking position.

2. A vehicular door locking device according to claim 1, wherein said locking device further includes an L-shaped intermediate lever fastened to said device body directly or indirectly via a third shaft, the axis of which extends at right angles to that of said first shaft, in such a manner that said intermediate lever can be turned, the other end portion of said rod being connected to one end portion of said intermediate lever, a rod which extends in parallel with said first shaft to said sill knob on said door being connected to the other end portion of said intermediate lever.

* * * * *